US005634861A

United States Patent [19]

Yamamoto et al.

[11] Patent Number: 5,634,861

[45] Date of Patent: Jun. 3, 1997

[54] GOLF CLUB SHAFT AND METHOD OF MANUFACTURING THE SAME

[75] Inventors: Shinji Yamamoto; Tatsuo Nishimoto, both of Hiratsuka, Japan

[73] Assignee: The Yokohama Rubber Co., Ltd., Japan

[21] Appl. No.: 533,748

[22] Filed: Sep. 26, 1995

[30] Foreign Application Priority Data

Sep. 29, 1994 [JP] Japan ..... 6-235525

[51] Int. Cl.[6] ..... A63B 53/10

[52] U.S. Cl. ..... 473/319; 273/DIG. 23

[58] Field of Search ..... 473/301, 316, 473/318, 322, 323, 319; 273/DIG. 23

[56] References Cited

U.S. PATENT DOCUMENTS

| | | | |
|---|---|---|---|
| 4,157,181 | 6/1979 | Cecka | 473/319 |
| 4,889,575 | 12/1989 | Roy | 473/319 |
| 5,242,720 | 9/1993 | Blake | 428/34.5 |
| 5,265,872 | 11/1993 | Tennent | 273/DIG. 23 |

FOREIGN PATENT DOCUMENTS 3-168168 7/1991 Japan .

*Primary Examiner*—Sebastiano Passaniti
*Assistant Examiner*—Stephen L. Blau
*Attorney, Agent, or Firm*—Finnegan, Henderson, Farabow, Garrett & Dunner, L.L.P.

[57] ABSTRACT

A golf club shaft according to the present invention is formed by winding annularly and unitarily in an overlapping state a reinforcing layer of a resin film comprising an organic polymer around the outer surface of a club shaft body of a fiber-reinforced resin in a manner that the reinforcing layer extends in a limited range from a front end of the club shaft body to the portion thereof which is not less than 150 mm and not more than 500 mm distant therefrom.

A method of manufacturing this golf club shaft has the steps of winding unitarily in an overlapping state a resin film formed out of an organic polymer and coated at one surface thereof which faces a club shaft body with a bonding agent around the outer surface of the club shaft body, which is formed cylindrically out of an uncured fiber-reinforced resin, in such a manner that the resin film extends between a front end of the club shaft body and the portion thereof which is not less than 150 mm and not more than 500 mm distant therefrom, and then thermally curing the resultant product.

9 Claims, 1 Drawing Sheet

GOLF CLUB SHAFT AND METHOD OF MANUFACTURING THE SAME

BACKGROUND OF THE INVENTION

This invention relates to a golf club shaft of a fiber-reinforced resin and a method of manufacturing the same, and more particularly to a golf club shaft formed so that the center of gravity of the club shaft and a kick point thereof are in the closest possible positions with respect to a grip and a club head respectively with the impact strength of the club shaft with respect to ball driving power imparted thereto, restraining an increase in the weight thereof and a method of manufacturing the same.

In general, when the weight of a golf club shaft is reduced with the length thereof left as it is, the swing balance of the club shaft can be small. As a result, the increasing of a head speed and the improving of a ball trajectory controllability are effected, and a flight distance of a ball and a flight direction stability thereof can be increased and improved respectively. When a club shaft is formed out of a lighter-weight material with the swing balance thereof unchanged, the length of the club shaft and/or the weight of a club head can be increased, so that a flight distance increasing effect can be expected.

By the way, when a wall thickness of a golf club shaft of a fiber-reinforced resin is reduced to lessen the weight thereof, the strength of, especially, a front end portion of the club shaft, which receives an impact when a ball is driven by a club head, becomes low. In order to prevent this inconvenience, a reinforcing layer of a fiber-reinforced resin is provided on the front end portion of the club shaft.

However, when a reinforcing layer of a fiber-reinforced resin is thus provided on the front end portion of a club shaft, the center of gravity of the club shaft is transferred toward a club head, and a kick point thereof toward a grip. Therefore, even when the weight of the club shaft body is reduced, a swing balance reducing effect cannot be expected much. Consequently, it is difficult to obtain the flight distance increasing and direction stability improving effects.

In order to set the impact strength of the front end portion of a club shaft not lower than a required predetermined level, it is necessary to provide thereon a plurality of reinforcing layers of a fiber-reinforced resin. This causes the specially obtained effect in reducing the weight of the club shaft body to decrease greatly.

Japanese Patent Application Kokai Publication No. 3-168168 proposes a golf club shaft of a fiber-reinforced resin provided with a tape-like film of an organic polymer as the outermost layer thereof. Providing such a tape-like film as the outermost layer of a club shaft is used as a means for securing an impact strength of the club shaft. However, since this tape-like film is provided on the whole surface of the club shaft body, the weight of the club shaft increases to a great extent accordingly, and the effect in reducing the weight of the shaft body based on the reduction of the wall thickness decreases greatly.

SUMMARY OF THE INVENTION

An object of the present invention is to provide a lighter-weight golf club shaft of a fiber-reinforced resin with a reinforcing layer thereon which can be transferring the center of gravity of the club shaft and a kick point thereof to the closest possible positions with respect to a grip and a club head respectively with the impact strength of the club shaft with respect to ball driving power imparted thereto and restrain of increasing the weight thereof retained and minimized respectively, and thereby reducing the swing balance of the club shaft, and a method of manufacturing the same.

Another object of the present invention is to provide a golf club shaft capable of undergoing a polishing process excellently with ease after a reinforcing layer is formed as the outermost layer of the club shaft, and a method of manufacturing the same.

The golf club shaft according to the present invention which achieves these objects is characterized in that a reinforcing layer of a resin film comprising an organic polymer is formed annularly on and integrally with a club shaft body of a fiber-reinforced resin in a way that the reinforcing layer extends not less than 150 mm and not more than 500 mm from the front end thereof.

The method of manufacturing the golf club shaft according to the present invention is characterized in that a resin film comprising an organic polymer and coated at one surface thereof which faces a club shaft body with a bonding agent is wound unitarily in an overlapping state around the outer surface of the club shaft body, which is formed cylindrically out of an uncured fiber-reinforced resin, in such a manner that the resin film extends not less than 150 mm and not more than 500 mm from the front end of the club shaft, and then thermally curing the club shaft body.

Since a reinforcing layer of a resin film comprising an organic polymer is layered unitarily on the portion of the surface of a club shaft body of a fiber-reinforced resin which is limited as mentioned above to a front end side thereof, the impact strength of the club shaft with respect to ball driving power imparted thereto is secured sufficiently, and an increase in the weight of the club shaft can be restrained effectively. Moreover, the reinforcing layer of a resin film has smaller weight and a lower bending elastic modulus than a conventional reinforcing layer of a fiber-reinforced resin, so that it becomes possible to transfer the center of gravity and a kick point of the club shaft closer toward a grip and a club head respectively than in the former club shaft having the former reinforcing layer of a fiber-reinforced resin. Therefore, the swing balance of the club shaft according to the present invention can be reduced.

In general, a golf club shaft is formed so that the diameter thereof decreases gradually toward the front end thereof, and the outer circumferential surface of the club shaft is polished for painting. According to the present invention, the club shaft is formed so that a reinforcing layer of a resin film is provided on the portion thereof extending not less than 150 mm from the front end thereof. This makes it possible to lower the variation of shape of the outer circumferential surface at a boundary portion between a reinforcing layer-carrying part and a non-reinforcing-layer-carrying part of the club shaft body by reducing the thickness of the rear end portion of the reinforcing layer of a resin film to a sufficiently low level while securing a sufficient thickness of the same layer on the front end portion, which has a large influence upon an impact, of the club shaft, and vary the shape of the outer circumferential surfaces of the front and rear end portions of the reinforcing layer of a resin film continuously and gently without causing a sudden variation of the shape to occur. If the shape of the reinforcing layer of a resin film varies greatly, it becomes difficult to polish the surface of the club shaft uniformly and obtain an excellent polished surface. According to the present invention, in which the variation of the shape of the outer surface of the reinforcing layer of a resin film is small, a polishing operation can be carried out excellently. Moreover, a failure not to polish a boundary portion between a reinforcing layer-carrying portion and a non-reinforcing-layer-carrying portion of the club shaft body or to polish it too much to be recessed can be prevented.

DESCRIPTION OF THE PREFERRED EMBODIMENTS

Figure 1:
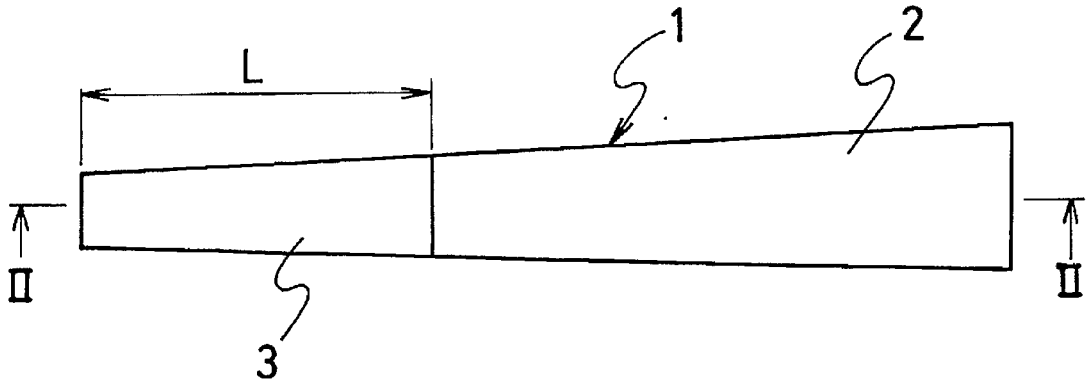
FIG. 1 is a front view showing an example of the golf club shaft according to the present invention.
Figure 2:
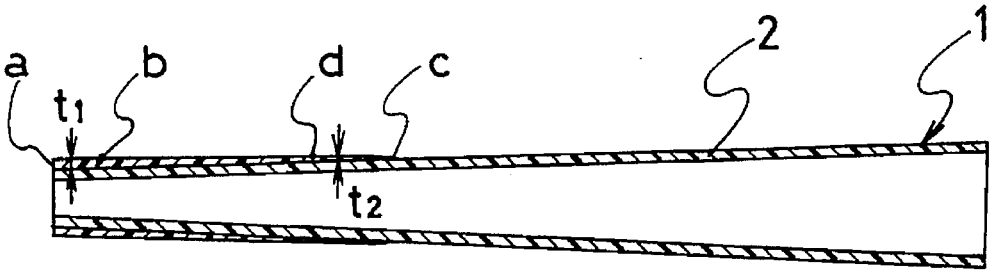
FIG. 2 is a sectional view taken along the line II—II with arrows in FIG. 1.

As shown in the drawings, a golf club shaft 1 according to the present invention comprises a club shaft body 2 of a fiber-reinforced resin, and a reinforcing layer 3 of a resin film wound annularly and integrally around the surface of a front end portion of the club shaft body 2.

The reinforcing fiber which can be used for the club shaft body 2 include known fiber, for example, carbon fiber, glass fiber, aramid fiber, boron fiber, alumina fiber, silicon carbide fiber and the like. Preferably, carbon fiber having a high specific strength and a high elastic modulus is used.

The same resins as are used for a conventional club shaft body can be used as a matrix resin for the club shaft body 2, include, for example, thermosetting resins, such as epoxy resin, phenol resin, polyurethane resin and the like, and thermoplastic resins, such as polypropylene resin, polyether either ketone resin, ABS resin, nylon resin and so on. Preferably, epoxy resin is used.

The club shaft body 2 is formed by cylindrically and unitarily laminating a plurality of bias layers in which reinforcing fiber is arranged so as to incline with respect to the axis of the club shaft and a plurality of straight layers in which reinforcing fiber is arranged in parallel with the mentioned axis.

The reinforcing layer 3 of this resin film is formed out of an organic polymer so that it extends in a range L of not less than 150 mm and not more than 500 mm from the front end a of the club shaft body 2. The organic polymers used for the reinforcing layer 3 of a resin film include, for example, aramid, polyimide, polyether ether ketone, total aromatic polyester, polybenzoimidazole, polybensobithiazole and the like. Preferably, aramid having a high strength with respect to an impact can be used.

Since the reinforcing layer 3 of a resin film comprising an organic polymer is provided on the above-mentioned limited front end portion of the outer surface of the club shaft body 2 of a fiber-reinforced resin, an increase in the weight of the club shaft can be restricted effectively with an impact strength thereof with respect to ball driving power imparted thereto secured sufficiently. Moreover, the weight and bending elastic modulus of the reinforcing layer 3 of a resin film are smaller and lower respectively than those of a conventional reinforcing layer of a fiber-reinforced resin having reinforcing fiber. Therefore, the center of gravity and a kick point of the club shaft having the reinforcing layer 3 can be transferred closer to a grip and club head respectively than in a club shaft having a reinforcing layer of a fiber-reinforced resin. This enables the swing balance of the club shaft 1 to be reduced.

And, in general, a golf club shaft is formed so that the diameter thereof decreases gradually (at a tapering rate of 6-15/1000) toward the front end thereof, and the outer circumferential surface of the club shaft is polished for painting. According to the present invention, the reinforcing layer 3 of a resin film is provided so that it extends not less than 150 mm from the frond end a of the club shaft body. Therefore, it is possible to make the variation of shape of the outer circumferential surface smaller at a boundary portion between a reinforcing layer-carrying part and a non-reinforcing-layer-carrying part of the club shaft body 2 by reducing the thickness of the rear end portion of the reinforcing layer 3 of a resin film while securing a sufficient thickness of the same reinforcing layer on the front end portion of the club shaft body. It is also possible to vary the shape of the outer circumferential surfaces between the front and rear end portions of the reinforcing layer of a resin film gently and continuously without causing a sudden variation of the shape. If the shape of the reinforcing layer 3 of a resin film varies greatly, it becomes difficult to polish the surface of the club shaft uniformly and obtain an excellent polished surface. According to the present invention, in which the variation of the shape of the outer surface of the reinforcing layer 3 of a resin film is small, a polishing operation can be carried out excellently, and a failure to polish a boundary portion between the part covered with the reinforcing layer 3 of a resin film and the part not covered therewith of the club shaft body 2 such as not polishing it or overpolishing to be recessed does not occur. Namely, an excellent polished surface can be formed easily on the outer circumferential side of the club shaft body 2 and reinforcing layer 3 of a resin film. Consequently, an excellent painted surface can always be formed on the club shaft.

When the range L in which the reinforcing layer 3 of a resin film is provided is smaller than 150 mm, it is difficult to obtain an excellent polished surface with a sufficient reinforcing effect secured, and, when this range exceeds 500 mm, an increase in the weight of the club shaft cannot be prevented effectively.

According to the present invention, it is preferable that the thickness of the reinforcing layer 3 of a resin film be set so that the impact strength of the portion of the golf club shaft 1 which is 30 mm distant from the front end thereof becomes not lower than 10J. This thickness differs depending upon the kind of a resin used, and is set suitably. For example, when a reinforcing layer of a aramid film is provided, the thickness t1 of the reinforcing layer 3 of the resin film extending from the front end a of the golf club shaft 1 (club shaft body 2) to a position b 50 mm away from the front end a can be set to not less than 0.1 mm. An upper limit level of this thickness is preferably set to 0.5 mm in view of the necessity of reducing the weight of the golf club shaft 1. The thickness of the reinforcing layer 3 of the resin film formed on the portion of the club shaft body which is above the position 50 mm distant from the front end thereof can be set to less than 0.1 mm since this portion of the club shaft body does not have a large influence upon the impact strength of the club shaft.

This reinforcing layer 3 of a resin film preferably has a tensile strength of not lower than 20 $kg/mm^2$ in addition to the above-mentioned physical properties.

In the reinforcing layer 3 of a resin film, the thickness t2 of a rear end portion thereof which is between a rear end c thereof and a portion d 50 mm away from the rear end c toward the front end is preferably set to not more than 0.05 mm. This enables the variation of shape of the outer surface of a boundary portion between the non-reinforcing-layer-carrying portion of the club shaft body 2 and a portion thereof having the reinforcing layer 3 to be small effectively, so that the polishing of this boundary portion can be carried out excellently. A lower limit level of the thickness of the rear end portion of the reinforcing layer 3 is preferably set to 0.01 mm so as to secure a thickness which permits the film-like tape to resist a tension applied thereto during the formation thereof.

According to the present invention, the reinforcing layer 3 of a resin film can also comprises a resin film colored in advance. The color tone of such a resin film can be varied partially or in a stepped manner. It is possible to have a golfer feel that a front end portion of his golf club shaft is thinner or thicker than it really is, by coloring this portion gradually darker or gradually brighter.

The golf club shaft 1 described above can be obtained by winding unitarilly in an overlapping state a resin film 3A of an organic polymer coated at one surface thereof which is to face a club shaft body 2A with a bonding agent (an uncured resin of a high adhesion with respect to the club shaft body) around the club shaft body 2A of an uncured fiber-reinforced resin formed cylindrically on a mandrel M (by winding in a laminated state a plurality of bias layers of prepreg arranged with the reinforcing fiber inclined with respect to the axis of the club shaft and a plurality of straight layers of prepreg arranged in parallel with the axis of the club shaft), in such a manner that the film extends not less than 150 mm and not more than 500 mm from the front end a, wrapping the resultant product with a wrapping tape, thermally curing the wrapped product, and then removing the wrapping tape and mandrel.

The resin film 3A forming the reinforcing layer 3 of a resin film comprises a tape-like or sheet type resin film. In order to obtain a reinforcing layer having partially different color tones or color tones varying in a stepped manner by using a colored transparent or colored translucent resin film, the following method can be used.

Figure 3:
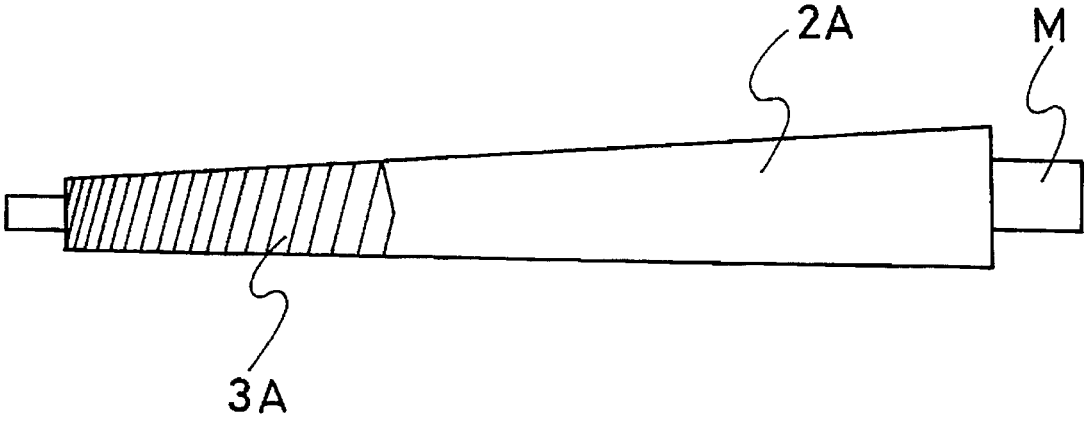
FIG. 3 is an explanatory drawing showing the condition of a club shaft with a tape-like resin film wound therearound in the method of manufacturing golf club shafts according to the present invention.

When the resin film 3A is a tape-like resin film, the film is wound around a front end portion of an uncured club shaft body 2A helically from the rear side to the front end thereof as shown in FIG. 3. During this time, the color tones of the portion of the club shaft body around which the resin film is provided (reinforcing layer 3 of a resin film) can be varied in a stepped manner by winding the resin film therearound by regulating a winding pitch in a way that it becomes gradually smaller. In order to partially vary the color tones, the winding pitch may be set smaller or larger at a desired portion of the club shaft body.

When the resin film 3A is a sheet type resin film, the number of overlaps thereof is regulated during the winding of the film around the surface of the uncured club shaft body 2A (overlapped sheet type films the size of which is varied), whereby the color tones can be varied partially or in a stepped manner.

In a conventional golf club shaft, a front end portion thereof is colored darker or brighter so as to have a golfer feel that the same portion is thinner or thicker than it really is. The coloring of a front end portion of a club shaft in this manner is done by spray coating a front end portion with a coloring agent, or by printing a desired color tone on a sheet which dissolves in a solution, floating the sheet on the solution to dissolve the sheet therein and isolate the coloring agent from the sheet onto the surface of the solution, and then immersing a golf club shaft in the solution to deposit the coloring agent only thereon. Since this coloring operation is carried manually, the skill of a worker is required when it is desired that the same type of golf club shafts having the same color tone be obtained. However, according to the present invention, in which a tape-like or sheet type resin film colored in advance is wound around a club shaft in the above-mentioned manner, the same color tones can be obtained very easily even by a non-skilled worker. Moreover, since a step of coloring a front end portion of a club shaft becomes unnecessary, the coloring operation step and the manufacturing cost can be reduced.

When the resin film 3A is a tape-like film, it is necessary that consideration be given to the tension applied thereto when it is wound around a tapering club shaft body 2A, for the purpose of winding the film closely in an overlapping state therearound without being wrinkled. The reason resides in that the elastic modulus of this tape is higher than that of a heat-shrinkable film of polyester or polypropylene used as a wrapping tape. For example, in the case of a tape-like film (aramid film) of 16 μm in thickness and 15 mm in width, a tension of at least not lower than 45 N is required.

When a tension is lower than 45 N, the tape-like film is not stretched sufficiently, and liable to be wrinkled. Consequently, the air readily enters between the layers of the film to cause a decrease in the strength of the film to occur and the external appearance thereof to be spoiled. When the tension is too high (in excess of 90 N) or when the film is wound in layers to cause the tightening force to become large, the reinforcing layer 3 of a resin film eats into a boundary portion between a reinforced portion and a non-reinforced portion of a molded club shaft body 2 due to the influence of heat-shrinkage of the film, and turbulence occurs in the orientation of the fiber. Therefore, local stress concentration and a decrease in the strength occur. Such inconveniences cannot be prevented even if the molding of an uncured club shaft body 2A formed by being impregnated with a resin at a certain ratio is done by increasing a rolling pressure or the tension of a wrapping tape. Although there is a method of preventing the occurrence of such phenomena, in which the winding pitch of the reinforcing film is set low at the boundary portion mentioned above and gradually higher toward the front end of the club shaft, merely setting the pitch low or high does not eliminate the phenomena.

EXAMPLES

Club shaft bodies of 1145 mm in total length were prepared by using carbon fiber as reinforcing fiber, and epoxy resin as a matrix resin, and providing four bias layers, two straight layers, and six auxiliary reinforcing layers at a front end portion of each thereof. A reinforcing layer of a resin film comprising an aramid film was provided on the club shaft bodies. These club shafts included club shafts 1–3 of the present invention and comparative club shafts 1 and 2 the ranges L of reinforcing layers of resin film on which were varied as shown in Table 1, a conventional club shaft 1 on a front end portion of which a layer of a carbon fiber-reinforced resin was formed so that the same portion had an impact strength equal to that of the corresponding portion of the club shaft according to the present invention, and a conventional club shaft 2 provided with a reinforcing layer of a resin film comprising an aramid film over the whole length thereof.

The wall thicknesses t1, t2 of the club shafts 1–3 according to the present invention and comparative club shafts 1 and 2 were 0.20 mm and 0.03 mm respectively. The thickness of the reinforcing layer of a resin film on the conventional club shaft 2 was 0.20 mm which was equal to the wall thickness t1 of the club shafts according to the present invention. The each impact strength of the portions of the club shafts according to the present invention, comparative club shafts and conventional club shaft 2, where they were 30 mm distant from the front ends thereof was 13.1 J, and that of the same portion of the conventional club shaft 1 14 J.

These test club shafts were subjected to evaluation tests for determining kick point, center of gravity, swing balance and weight under the following measurement conditions to obtain the results shown in Table 1.

The club shafts 1–3 according to the present invention and comparative club shafts 1 and 2 were polished by a regularly used method, and the polished condition thereof was checked visually to obtain the results shown in Table 1. The 0 represent a good polished condition, and the x a poor polished condition.

Kick Point

Each test club shaft was compressed from both ends and buckled to determine a position in which the amount of deformation was the largest. The results were shown by indexes based on the figure 100 for the conventional club shaft 1 as a standard. Larger values indicate that the kick points are closer to the grips.

Center of Gravity

Each test club shaft was placed on a blade of not more than 1 mm in thickness to determine a point at which the club shaft was balanced horizontally. The results were shown by indexes based on the figure 100 for the conventional club shaft 1 as a standard. Larger values indicate that the centers of gravity are closer to the grips.

Swing Balance

The same club head and grip were attached to each test club shaft, and the moment of the club shaft was determined with a position thereon 14 inches distant from the grip end utilized as a fulcrum. The results were evaluated by indexes based on the figure 0 for the conventional club shaft 1 as a standard. The moment variation of 1260 g·mm was calculated as one point. Smaller values indicate smaller swing balance.

Weight

The weight of each test club shaft was determined by using a measuring instrument, and the results were evaluated by indexes based on the figure 100 for the conventional club shaft 2 as a standard. Larger values indicate larger weight.

As is clear from Table 1, the club shafts 1–3 according to the present invention enables an increase in the weight to be lower with the impact strength secured, the center of gravity and kick point to be transferred to positions on the side of the grip and club head respectively, and the swing balance to be reduced. It is understood from the table that, even when the range of reinforcement of the comparative club shaft 2 is set larger than 500 mm, an effect in transferring the kick point toward the club head is not obtained, and that the center of gravity is transferred farther toward the club head and the weight is increased merely than in a club shaft in which the range of reinforcement is set not more than 500 mm. It is also understood that the club shafts 1–3 according to the present invention were all polished excellently.

According to the present invention, a reinforcing layer of a resin film comprising an organic polymer is overlapped unitarily on the surface of a club shaft body of a fiber-reinforced resin in a way that the reinforcing layer extends from the front end of the club shaft to a portion thereof which is not less than 150 mm and not more than 500 mm distant from the front end. Therefore, an increase in the weight of the club shaft can be restrained effectively with a sufficiently high impact strength with respect to a shock occurring when a ball is driven thereby. Moreover, the weight and bending elastic modulus of the reinforcing layer of a resin film used in the present invention are smaller and lower respectively than those of a reinforcing layer of a fiber-reinforced resin used for a conventional club shaft, so that the center of gravity and kick point of the club shaft according to the present invention can be transferred farther toward the grip and club head respectively than those of a club shaft having such a reinforcing layer of a fiber-reinforced resin. Consequently, the swing balance of the golf club shaft according to the present invention can be reduced.

In this club shaft, a reinforcing layer of a resin film is provided on the portion thereof which is not less than 150 mm distant from the front end thereof. This makes it possible to lower the variation of the shape of the outer surface of a boundary portion between a reinforcing layer-carrying part and a non-reinforcing-layer-carrying part of the club shaft body by reducing the thickness of a rear end portion of the reinforcing layer of a resin film to a low level while securing a sufficient thickness of the same layer on a front end portion thereof which has a large influence upon an impact, and vary the outer surfaces between the front and rear end portions of the reinforcing layer of a resin film continuously and gently without causing a sudden variation of the shape thereof to occur. This enables the outer surface of the reinforcing layer of a resin film, which is difficult to be polished excellently if the variation of the shape thereof is large, to be polished excellently. Moreover, a failure to polish a boundary portion

TABLE 1

| | Comparative | Present Invention | | | Comparative | Conventional | Conventional |
|---|---|---|---|---|---|---|---|
| | club shaft 1 | club shaft 1 | club shaft 2 | club shaft 3 | club shaft 2 | club shaft 1 | club shaft 2 |
| Range L (mm) | 100 | 150 | 300 | 500 | 600 | — | — |
| Kick point | 94.9 | 95.1 | 95.3 | 95.4 | 95.4 | 100 | 95.2 |
| Center of Gravity | 104.1 | 103.9 | 103.7 | 103.5 | 102.9 | 100 | 100.5 |
| Swing balance | −2.14 | −2.03 | −1.85 | −1.60 | −1.34 | ±0 | +0.48 |
| Weight | 77.3 | 78.2 | 80.0 | 82.7 | 85.1 | 92.7 | 100 |
| Polishing characteristics | X | O | O | O | O | — | — |

between a reinforcing layer-carrying portion and a non-reinforcing-layer-carrying portion of the club shaft body or the overpolishing of the mentioned surface which causes the same surface to be recessed can be prevented. This enables the outer circumferential surfaces of the non-reinforcing-layer-carrying portion and reinforcing layer-carrying portion of the club shaft to be polished uniformly, i.e., an excellently polished surface of the club shaft can be obtained easily.

What is claimed is:

1. A golf club shaft comprising a club shaft body made of a fiber-reinforced resin and a reinforcing layer of a resin film formed of an organic polymer and overlapped annularly on and unitarily with a surface of the club shaft body, said reinforcing layer extending on the club shaft body from a front end of said club shaft body towards a rear end of said club shaft body for a distance of not less than 150 mm and not more than 500 mm; wherein a rear end portion of said reinforcing layer which extends from a rear end of said reinforcing layer to a point on said reinforcing layer which is 50 mm distant from said rear end toward the front end of said club shaft body has a thickness of from 0.01 to 0.05 mm;

a portion of said golf club shaft which is 30 mm distant from a front end of said golf club shaft has an impact strength not lower than 10 J; and said rear end portion of said reinforcing layer has a reduced thickness relative to the thickness of a front end portion of said reinforcing layer that extends from the front end of said club shaft body toward the rear end of said reinforcing layer to a point 30 mm distant from said front end.

2. A golf club shaft according to claim 1, wherein said reinforcing layer of a resin film comprises an aramid film, the thickness of a portion of said reinforcing layer of a resin film which is between the front end of said golf club shaft and a point which is 50 mm distant from the front end is not less than 0.1 mm.

3. A golf club shaft according to claim 1, wherein said reinforcing layer of a resin film comprises a resin film colored in advance of being placed on said club shaft body.

4. A golf club shaft according to claim 1, wherein the tone of color of said reinforcing layer of a resin film varies partially or in a stepped manner.

5. A golf club shaft according to claim 4, wherein said resin film comprises a tape-like helically wound resin film, and a tone of color of the portion of said club shaft body which is provided with said resin film is varied partially or in a stepped manner by regulating the pitch of said helically wound resin film.

6. A golf club according to claim 4, wherein said film comprises a wound and overlapped sheet type resin film, and a tone of color of the portion of said club shaft body which is provided with said resin film is varied partially or in a stepped manner by regulating the number of overlaps of said wound resin film.

7. A golf club shaft according to claim 1, wherein said reinforcing layer is transparent or translucent.

8. A golf club according to claim 1, wherein the golf club shaft has a diameter which gradually decreases along its length toward the front end thereof.

9. A golf club shaft according to claim 8, wherein said diameter decreases at a tapering rate of from 6/1000 to 15/1000.

* * * * *